US008224517B2

(12) United States Patent
Eser et al.

(10) Patent No.: US 8,224,517 B2
(45) Date of Patent: Jul. 17, 2012

(54) METHOD AND DEVICE FOR DIAGNOSING A COOLANT PUMP FOR AN INTERNAL COMBUSTION ENGINE

(75) Inventors: Gerhard Eser, Hemau (DE); Stefan Seyfferth, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/999,670

(22) PCT Filed: Jun. 10, 2009

(86) PCT No.: PCT/EP2009/057184

§ 371 (c)(1),
(2), (4) Date: Dec. 17, 2010

(87) PCT Pub. No.: WO2010/003754

PCT Pub. Date: Jan. 14, 2010

(65) Prior Publication Data

US 2011/0098883 A1 Apr. 28, 2011

(30) Foreign Application Priority Data

Jul. 8, 2008 (DE) ..... 10 2008 032 130

(51) Int. Cl.
*G01M 17/00* (2006.01)

(52) U.S. Cl. ..... 701/31.4; 123/41.01

(58) Field of Classification Search ..... 701/35, 701/29, 31.4; 123/41.01
See application file for complete search history.

(56) References Cited

U.S. PATENT DOCUMENTS 6,321,695 B1 * 11/2001 Yoo et al. ..... 123/41.15
6,390,081 B1 * 5/2002 Novak et al. ..... 123/676
6,615,772 B2 * 9/2003 Ichinose et al. ..... 123/41.14
7,380,983 B2 * 6/2008 Bayerle et al. ..... 374/144
7,810,457 B2 * 10/2010 Blassnitz et al. ..... 123/41.33
2002/0195068 A1 12/2002 Ichinose et al. ..... 123/41.14
2004/0184507 A1 9/2004 Tsukamoto et al. ..... 374/57
2007/0065693 A1 3/2007 Tighe et al. ..... 429/24

FOREIGN PATENT DOCUMENTS

DE 10226928 1/2004
WO 9915769 4/1999

OTHER PUBLICATIONS

International Search Report and Written Opinion for Application No. PCT/EP2009/057184 (18 pages), Sep. 4, 2009.
Chinese Office Action, Chinese Patent application No. 200980124374.1, 18 pages, Nov. 23, 2011.

* cited by examiner

*Primary Examiner* — Thomas G. Black
*Assistant Examiner* — Shardul Patel
(74) *Attorney, Agent, or Firm* — King & Spalding L.L.P.

(57) ABSTRACT

In order to diagnose a coolant pump (11) which is provided for the purpose of circulating a coolant in a closed cooling circuit of an internal combustion engine (10) and which can be activated and deactivated independently of the operating state of the internal combustion engine (10), both a value representing the coolant temperature (TCO) of the internal combustion engine (10) and a value representing the cylinder head temperature (TZK) of the internal combustion engine (10) are determined at a predefined time instant (t2) after a cold start of the internal combustion engine (10) has been detected and the values are subsequently compared with each other. The coolant pump (11) is rated in terms of its operational integrity as a function of the result of the comparison. This enables a faulty coolant pump to be detected at a very early stage after a cold start of the internal combustion engine.

21 Claims, 3 Drawing Sheets

METHOD AND DEVICE FOR DIAGNOSING A COOLANT PUMP FOR AN INTERNAL COMBUSTION ENGINE

CROSS-REFERENCE TO RELATED APPLICATIONS

This application is a U.S. National Stage Application of International Application No. PCT/EP2009/057184 filed Jun. 10, 2009, which designates the United States of America, and claims priority to German Application No. 10 2008 032 130.3 filed Jul. 8, 2008, the contents of which are hereby incorporated by reference in their entirety.

TECHNICAL FIELD

The invention relates to a method for diagnosing a coolant pump which is provided for the purpose of circulating a coolant in a closed cooling circuit of an internal combustion engine and which can be activated and deactivated independently of the operating state of the internal combustion engine.

BACKGROUND

Peak temperatures of more than 2000° C. can occur during the combustion of the fuel-air mixture in the combustion chamber of an internal combustion engine. A means of cooling is required in order to prevent a thermal overload of the materials used for cylinder head, valves, spark plugs, injection valves, cylinders, pistons, piston rings, gaskets, etc. Forced circulation cooling by means of a cooling fluid has become widely established for this purpose. In such a system cylinder and cylinder head are implemented as double-walled. The interspace is filled with a cooling fluid and embodied in such a way that a coolant circuit is produced. A mixture of water, antifreezing agent and inhibitors specific to the particular situation is used as the cooling fluid.

Such conventional cooling systems usually include a coolant pump that is driven by the internal combustion engine either directly or indirectly by way of a moving traction mechanism, e.g. a fan belt, and an expansion material thermostat. The coolant pump therefore operates as a function of the rotational speed of the engine and is configured in such a way that an adequate flow of coolant is made available in every operating state of the internal combustion engine. The coolant temperature is regulated in order to maintain a coolant temperature, and hence also an internal combustion engine temperature, that remains constant within narrow limits. Toward that end a temperature-dependent expansion material controller is provided which actuates a valve that allows an increasing flow of coolant to stream past the radiator if the coolant temperature decreases. The expansion material controller and valve form a structural unit and are generally referred to as a radiator thermostat.

Starting from the cold operating state of the internal combustion engine, the radiator thermostat is initially closed and the circulation of coolant takes place exclusively in a bypass circuit of the internal combustion engine. This is also referred to as the "small cooling circuit". At or above a specific coolant temperature the radiator thermostat opens and the flow of coolant is conducted to the radiator, is cooled down there owing to the air stream and/or the radiator fan, and is conducted back again to the internal combustion engine. This is also referred to as the "large cooling circuit".

DE 102 26 928 A1 discloses a method for operating a liquid-cooled internal combustion engine in which the coolant is circulated as necessary by means of a coolant pump within a closed coolant circuit. As a function of a variable characterizing the temperature of the internal combustion engine, the coolant volume flow is switched over by means of an actuating element from a first coolant circuit connecting a coolant inlet and a coolant outlet of the internal combustion engine to a second coolant circuit containing a radiator of the internal combustion engine. At the coolant outlet of the internal combustion engine the coolant volume flow can be split as a function of said variable into a first coolant volume flow in the first coolant circuit and into a second coolant volume flow into a bypass containing at least one oil coolant heat exchanger. This means that after a cold start of the internal combustion engine has been detected the actuating element can be controlled in such a way that the coolant volume flow is channeled exclusively via the bypass containing the oil coolant heat exchanger, thus leading to rapid heating of the lubricants such as engine oil and/or transmission oil and/or hydraulic oil.

A particularly rapid warmup of the internal combustion engine, and in consequence thereof also of the lubricants, is achieved if initially, starting from cold start conditions of the internal combustion engine, no circulation of the coolant takes place, resulting in very rapid heating of the relatively small coolant volume contained in the cooling jacket of the internal combustion engine. This can be achieved, for example, by means of a suitable coolant mixing valve or, in the case of a coolant pump driven mechanically by the internal combustion engine, by provision of a switchable coupling. In cooling systems having an electrically driven coolant pump the cooling circuit can be interrupted in a simple manner by switching off the electric motor of the coolant pump. Since in this case the coolant no longer circulates, it is also referred to as a "standing coolant".

Toward that end it is proposed in DE 102 26 928 A1 to use an electrically driven coolant pump which is switched off at this operating point of the internal combustion engine. As a result of the thus achieved minimization of the warmup time and reduced friction due to the lower oil viscosity at higher temperatures, fuel consumption is lowered and more favorable emission characteristics are to be observed into the bargain.

The problem that arises with such an approach resides in the fact that coolant temperature sensors are usually arranged outside of the internal combustion engine, mostly in a line at the coolant outlet of the cylinder head, and consequently no longer supply reliable signals concerning the thermal operating state of the internal combustion engine itself, in particular concerning the temperature prevailing in the cylinder head. In order to obtain an accurate value for the temperature of the internal combustion engine nonetheless, even when the coolant pump is deactivated, recourse is made at least in the warmup phase of the internal combustion engine to the signal of a temperature sensor arranged at or in the cylinder head of the internal combustion engine.

Since the operation or, as the case may be, non-operation of the coolant pump therefore has an effect both on the warmup behavior of the internal combustion engine on the one hand, and on the emission characteristics, in particular at the time of a cold start, on the other, the pump must be monitored in order to verify that it is operating correctly. A defective or deactivated coolant pump can lead to unacceptable overheating of the internal combustion engine, while a coolant pump that is always active at the time of a cold start of the internal combustion engine can lead to increased pollutant emissions.

SUMMARY

According to various embodiments, a method and a device for diagnosing a coolant pump for an internal combustion engine of the type cited in the introduction can be provided by means of which faults can be detected in a simple manner.

According to an embodiment, in a method for diagnosing a coolant pump which is provided for the purpose of circulating a coolant in a closed cooling circuit of an internal combustion engine and which can be activated and deactivated independently of the operating state of the internal combustion engine,—at a predefined time instant after a cold start of the internal combustion engine has been detected, both a value representing the coolant temperature of the internal combustion engine and a value representing the cylinder head temperature of the internal combustion engine are determined and subsequently said values are compared with each other, and—the coolant pump is rated in terms of its operational integrity as a function of the result of the comparison.

According to a further embodiment, the coolant pump can be activated only after a predetermined time interval has elapsed since the cold start of the internal combustion engine and the temperature values are determined and compared after a further predetermined time interval has elapsed. According to a further embodiment, a check can be carried out to determine whether the result of the comparison lies within a first tolerance range defined by predefined limits, and the coolant pump is rated as faulty if the result of the comparison lies outside the tolerance range. According to a further embodiment, the coolant pump can be activated only after a predetermined time interval has elapsed since the cold start of the internal combustion engine and the temperature values are determined and compared at said time instant. According to a further embodiment, a check can be carried out to determine whether the result of the comparison lies within a second tolerance range defined by predefined limits, and the coolant pump controller is rated as faulty if the result of the comparison lies outside the tolerance range. According to a further embodiment, a frequency counter can be activated which counts the number of comparison results lying outside the tolerance ranges and the coolant pump or the coolant pump controller is rated as faulty only when the number exceeds a predefined maximum permissible frequency. According to a further embodiment, the comparison can be made by forming the difference between the two temperature values. According to a further embodiment, the limits of the tolerance ranges and the time intervals can be determined experimentally on a test bench.

According to another embodiment, a device for diagnosing a coolant pump which is provided for the purpose of circulating a coolant in a closed cooling circuit of an internal combustion engine and which can be activated and deactivated independently of the operating state of the internal combustion engine, may comprise a facility for determining a value representing the coolant temperature, a facility for determining a value representing the cylinder head temperature, a comparator facility for comparing the values representing the coolant temperature and the cylinder head temperature, an assessment facility which rates the coolant pump in terms of its operational integrity as a function of the result of the comparator unit, and a fault management facility that has a fault memory and/or a fault indicator device for storing a fault code and/or outputting a warning message in the event of a faulty coolant pump.

According to a further embodiment of the device, the facility for determining a value representing the coolant temperature may include a temperature sensor. According to a further embodiment of the device, the facility for determining a value representing the coolant temperature may include a model which calculates the coolant temperature from operating variables of the internal combustion engine. According to a further embodiment of the device, the facility for determining a value representing the cylinder head temperature may include a temperature sensor. According to a further embodiment of the device, the facility for determining a value representing the cylinder head temperature may include a model which calculates the cylinder head temperature from operating variables of the internal combustion engine. According to a further embodiment of the device, the coolant pump may be embodied as an electrically driven pump. According to a further embodiment of the device, the electrically driven pump may be embodied as a pump that can be regulated in terms of its output capacity. According to a further embodiment of the device, the electrically driven pump can be embodied as a pump that is reversible in terms of its coolant delivery direction. According to a further embodiment of the device, the coolant pump can be embodied as a pump that is driven mechanically by the internal combustion engine and whose drive can be activated and deactivated as necessary. According to a further embodiment of the device, the facilities may constitute component parts of a control facility controlling and regulating the internal combustion engine.

BRIEF DESCRIPTION OF THE DRAWINGS

Other developments are explained in more detail below in conjunction with the description of the different embodiments and with reference to the figures, in which.

DETAILED DESCRIPTION

Figure 1:
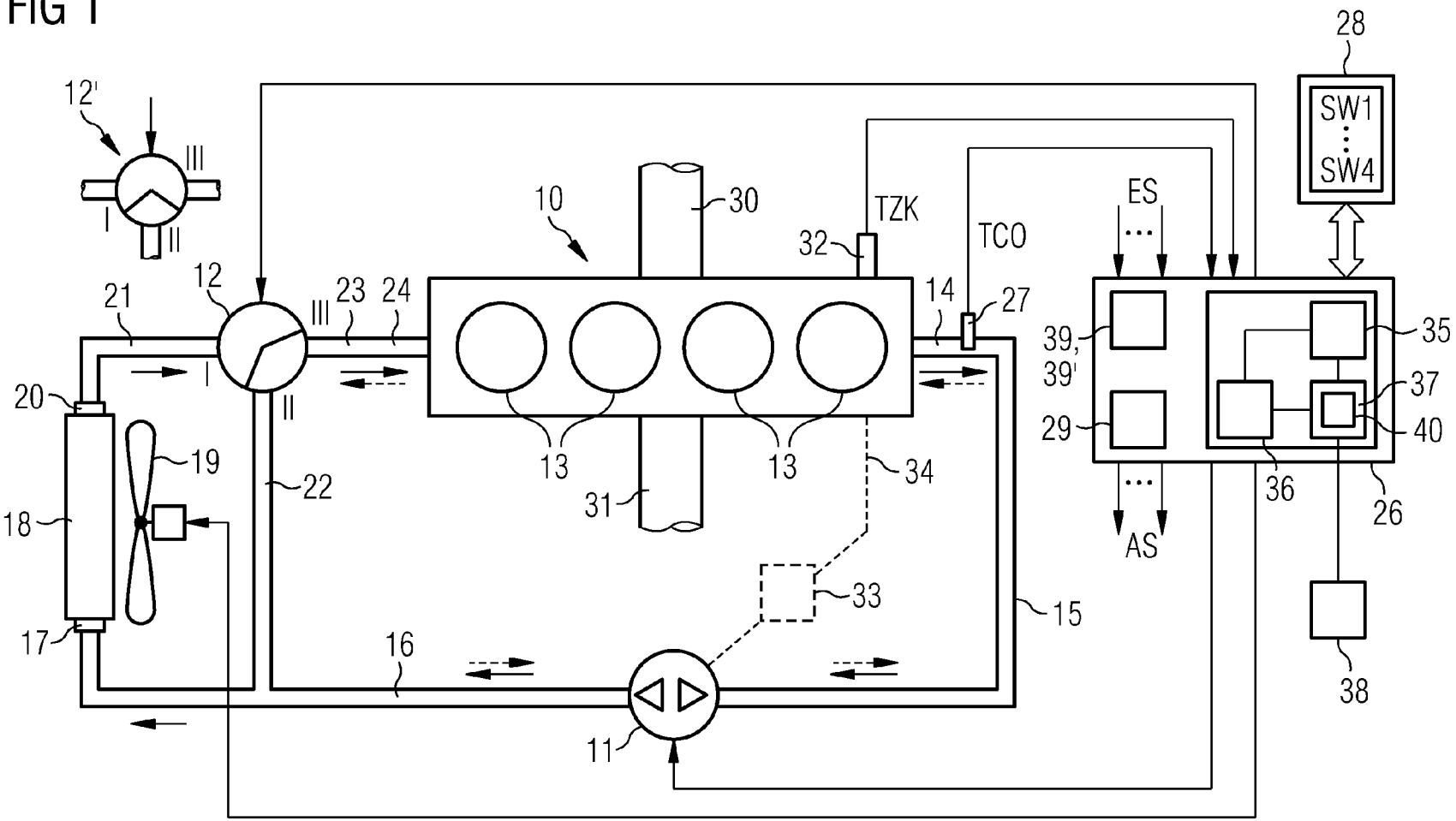
FIG. 1 is a schematic representation of a coolant circuit of an internal combustion engine.

The various embodiments include the general technical teaching that in order to diagnose a coolant pump which is provided for the purpose of circulating a coolant in a closed cooling circuit of an internal combustion engine and which can be activated and deactivated independently of the operating state of the internal combustion engine, both a value representing the coolant temperature of the internal combustion engine and a value representing the cylinder head temperature of the internal combustion engine are determined at a predefined time instant after a cold start of the internal combustion engine has been detected and said values are subsequently compared with each other, the coolant pump being rated in terms of its operational integrity as a function of the result of the comparison.

By drawing on a further value representing the heating-up at the time of a cold start of the internal combustion engine, namely the cylinder head temperature, and validity-checking said signal against a value representing the coolant temperature it is possible in a simple and cost-effective manner to assess the operational integrity of the coolant pump of the internal combustion engine.

By suitable selection of the interrogation time for the temperatures occurring after a cold start of the internal combustion engine it is possible to differentiate between different fault causes.

If the coolant pump is activated only after a predetermined time interval has elapsed since the cold start of the internal combustion engine and the said temperature values are determined and compared after a further predetermined time interval has elapsed, it can be ascertained in a simple manner whether the coolant pump is operating correctly or whether despite having been activated it is not circulating coolant, because, for example, there is no non-positive or positive connection between pump wheel and pump shaft or some other mechanical fault is present. There is then a significant difference between the two temperature values at this time of the temperature interrogations. After such a fault has been detected suitable emergency measures can be initiated, such as limiting the rotational speed or the load for example, thereby preventing overheating of the internal combustion engine.

If the coolant pump is activated only after a predetermined time interval has elapsed since the cold start of the internal combustion engine and the temperature values are determined and compared already at this time, it can be ascertained on the basis of the result of the comparison whether the coolant pump is operating correctly or whether the coolant pump was already switched on from the time of the cold start of the internal combustion engine and can no longer be deactivated. There is then only an insignificant difference between the two temperature values at this time of the temperature interrogations.

A simple indicator for the correct functioning of the coolant pump can be obtained if a check is carried out to determine whether the result of the comparison of the two temperature values in each case lies within a tolerance range defined by predefined limits, and the coolant pump is rated as defective if the result of the comparison lies outside the tolerance range.

According to an embodiment a frequency counter is activated which counts the number of comparison results lying outside the tolerance range and the coolant pump or coolant pump controller is rated as faulty only when the number exceeds a predefined maximum permissible frequency. This has the advantage that only reproducibly occurring fault events are also actually entered, which results in a robust system.

The comparison can be performed particularly easily if the difference between the two temperature values is formed at the specified times and the value thus obtained is checked to determine whether it lies within the respective tolerance range.

In an embodiment the limits of the tolerance ranges and the time intervals are determined experimentally on a test bench for the internal combustion engine. Criteria for assessing the operational capability of the coolant pump are thus obtained in a simple manner.

The device according to various embodiments for diagnosing a coolant pump which is provided for the purpose of circulating a coolant in a closed cooling circuit of the internal combustion engine and which can be activated and deactivated independently of the operating state of the internal combustion engine is characterized in that it comprises the following:

- a facility for determining a value representing the coolant temperature,
- a facility for determining a value representing the cylinder head temperature,
- a comparator facility for comparing said two temperature values,
- an assessment facility which rates the coolant pump in terms of its operational integrity as a function of the result of the comparator unit, and
- a fault management facility which has a fault memory and/or a fault indicator device for storing a fault code and/or outputting a warning message in the event of a defective coolant pump.

With regard to the advantages that result therefrom, the reader is referred to the statements made in relation to the method.

The two temperature values can be obtained particularly easily if the facility for determining a value representing the coolant temperature includes a temperature sensor and the facility for determining a value representing the cylinder head temperature (TZK) includes a temperature sensor.

According to a development the facilities for determining a value representing the coolant temperature and the facility for determining a value representing the cylinder head temperature each include a model which in each case calculates the said temperatures from operating variables of the internal combustion engine. This results in a particularly cost-effective device, since the sensors can be dispensed with in this case.

FIG. 1 shows an internal combustion engine identified in its entirety by the reference numeral 10. It can be embodied as a spark-ignition internal combustion engine or as a diesel internal combustion engine, or indeed as an internal combustion engine having a hybrid drive, with only the components necessary to an understanding of the various embodiments being depicted. It comprises at least one cylinder. In the example shown the internal combustion engine 10 has four cylinders 13. The fresh air required for combustion of the fuel is supplied via an engine air intake 30 that is represented only schematically. The fuel can be distributed for example directly into the combustion chamber or combustion chambers (direct fuel injection) or by means of injection into one or more intake pipes (intake manifold fuel injection). The exhaust gases produced in the combustion process are discharged by way of an exhaust system 31 that is likewise represented only schematically. In order to clean the exhaust gas, one or more exhaust gas catalytic converters having associated exhaust gas sensors and at least one exhaust silencer are preferably arranged in the exhaust system 31. An air filter, one or more load sensors in the form of a mass air flow meter or intake pipe pressure sensor, a throttle valve having associated sensors, an intake air temperature sensor, and further sensors necessary for controlling the internal combustion engine can be provided for example in the traditional manner in the engine air intake 30. The internal combustion engine can also be equipped with a facility for compressing the intake air (electric or mechanical compressor, exhaust gas turbocharger).

The internal combustion engine 10 additionally has a cooling system, with again only the components necessary to an understanding of the various embodiments being depicted. In particular the heating heat exchangers serving for heating the interior of a motor vehicle, the coolant expansion tank, and an oil coolant heat exchanger together with the associated branch lines have been omitted from the illustration of the cooling system of the internal combustion engine. The path of the coolant volume flow inside the coolant circuit is indicated by arrow symbols in each case.

The coolant circuit of the internal combustion engine 10 has a coolant pump 11 which in the exemplary embodiment shown is embodied as an electrically driven coolant pump. In particular said coolant pump can also be implemented, for example, as a pump that can be controlled or regulated in terms of its output capacity and/or as a pump that is reversible in terms of its delivery direction. In another embodiment the coolant pump 11 can also be realized as a pump that is mechanically driven by the internal combustion engine by way of a driving means 34. In this case it must merely be ensured that in certain operating ranges of the internal combustion engine, in particular at the time of a cold start of the internal combustion engine, said coolant pump can be decoupled from the drive, for example by means of a clutch that is required to be actuated mechanically or electrically or by means of a mechanical or electrical switching facility 33 or by selecting a neutral position of a transmission connected between the internal combustion engine and the coolant pump, as indicated by the dashed lines in FIG. 1.

The internal combustion engine 10 has a cooling jacket (not shown) around the cylinders 13 and the coolant pump 11 delivers the coolant into the cooling jacket around the cylinders 13, the coolant reaching the cylinder head by way of through-holes. Provided at the cylinder head of the internal combustion engine 10 is a coolant outlet 14 to which a line 15 is connected. The line 15 leads to a port (not designated in further detail) of the coolant pump 11. The other port of the coolant pump 11 leads by way of a line 16 to a coolant inlet 17 of a radiator 18. In the radiator 18, the waste heat being generated in the internal combustion engine 10 is discharged to the environment by way of the coolant. At least one, preferably electrically driven, fan 19 is provided in addition in order to generate high cooling capacities even at low speeds of the motor vehicle. Activation of the fan 19 is typically controlled or regulated as a function of temperature.

A coolant outlet 20 of the radiator 18 is connected by way of a line 21 to an input I of an actuating element 12. A junction for a bypass line 22 which leads to an input II of the actuating element 12 is provided in the line 16 which connects the coolant pump 11 to the coolant inlet 17 at the radiator 18. An output III of the actuating element 12 is connected to an engine-side coolant inlet 24 by way of a line 23.

In a simple embodiment variant the actuating element 12 is implemented as a conventional radiator thermostat which contains an expansion material element, for example, and connects either the ports II and III (12 in FIG. 1) or the ports I and III (12' in FIG. 1) as a function of the temperature prevailing at the expansion material element, so that the coolant can be circulated in what is referred to as a small coolant circuit, bypassing the radiator 18, or in what is referred to as a large coolant circuit in which the radiator 18 is incorporated.

An electrically controllable actuating element 12 in the form of a 3/2-way proportional valve, as shown explicitly in FIG. 1, can also be provided instead of the conventional radiator thermostat. By appropriate control of the actuating element 12 by means of electrical signals the coolant volume flow can also be switched over independently of the temperature of the coolant in accordance with the operating range of the internal combustion engine 10.

A temperature sensor 27 at the engine-side coolant outlet 14 supplies a signal TCO corresponding to the temperature of the coolant at the engine-side coolant outlet. A further temperature sensor 32 which is arranged on or in the engine block, preferably on or in the cylinder head of the internal combustion engine 10, supplies a signal TZK corresponding to the temperature of the cylinder head.

An electronic control facility 26 is also assigned to the internal combustion engine. Such control facilities, which typically contain one or more microprocessors as well as an elapsed-time meter 29 and which handle a plurality of control and regulating tasks of the internal combustion engine 10, as well as performing diagnostic functions of relevant components of the internal combustion engine, in particular on-board diagnoses, are known per se, so only the layout relevant in connection with the various embodiments and its mode of operation will be dealt with hereinbelow.

The control facility 26 is embodied for executing programs which are stored in the control facility itself or in a memory coupled thereto. For that purpose engine-operating-map-based engine control functions are implemented by software means inter alia in the control facility 26. The control facility 26 is assigned sensors which detect various measured variables and in each case determine the measured value of the measured variable. As a function of at least one of the measured variables the control facility 26 determines actuating variables which are then converted into corresponding control signals for controlling actuating elements or actuators by means of corresponding actuating drives.

The sensors are, for example, a pedal position sensor which detects the position of an accelerator pedal, a crankshaft angle sensor which measures a crankshaft angle and to which a rotational speed is then assigned, a mass air flow meter, an oil temperature sensor which records an oil temperature value, a torque sensor or an intake air temperature sensor, as well as the temperature sensor 27 for measuring the coolant temperature TCO and the temperature sensor 32 for measuring the cylinder head temperature TZK. The input signals recorded by means of the corresponding sensors are designated generally in FIG. 1 by the reference sign ES.

Let the gas inlet or gas outlet valves, the injection valves, the spark plugs, the throttle valve of the internal combustion engine 10, and the coolant pump 11, the actuating element 12, and also the fan 19 of the cooling system of the internal combustion engine 10 be cited as examples of actuating elements. The output signals to the individual actuating elements or actuators are designated generally in FIG. 1 by the reference sign AS.

Additionally implemented in the control facility 26 are facilities 35, 36 for comparing and assessing the values obtained by the temperature sensors 27, 32 for the coolant temperature TCO and the cylinder head temperature TZK, as well as a fault management facility 37 for storing or outputting the result of the diagnosis. An identified fault of the coolant pump 11 can be signaled visually and/or acoustically to the driver of the motor vehicle driven by means of the internal combustion engine 10 by means of an indicator device 38.

Instead of the temperature sensors 27, 32 for measuring the coolant temperature TCO and the cylinder head temperature TZK respectively, there can also be stored in the control facility 26 models (39, 39') with the aid of which these temperatures can be calculated from other relevant operating variables of the internal combustion engine according to known methods. Possible input variables of such models are, for example, a selection/combination of the following variables: rotational speed, load, intake air temperature, ambient air temperature, material coefficients for the heat carriage or heat transmission of the materials used, in particular for the cylinder head and the coolant, air humidity, air density, temperatures at the time the internal combustion engine is switched off, time switched off between two startup operations.

Figure 2:
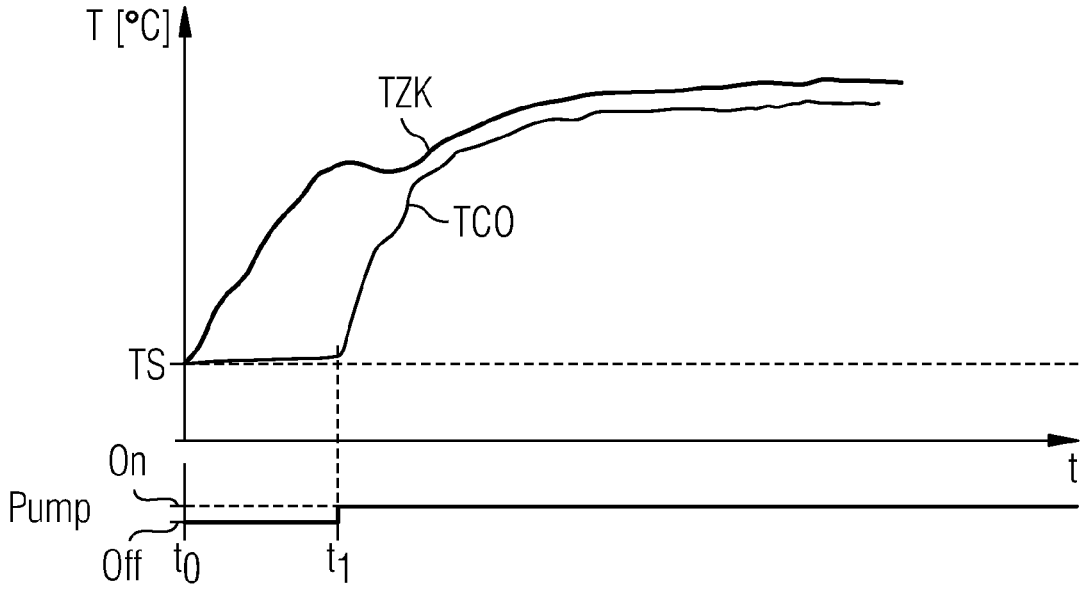
FIG. 2 shows the time characteristic of the coolant temperature and the cylinder head temperature in a correctly operating coolant pump.
Figure 3:
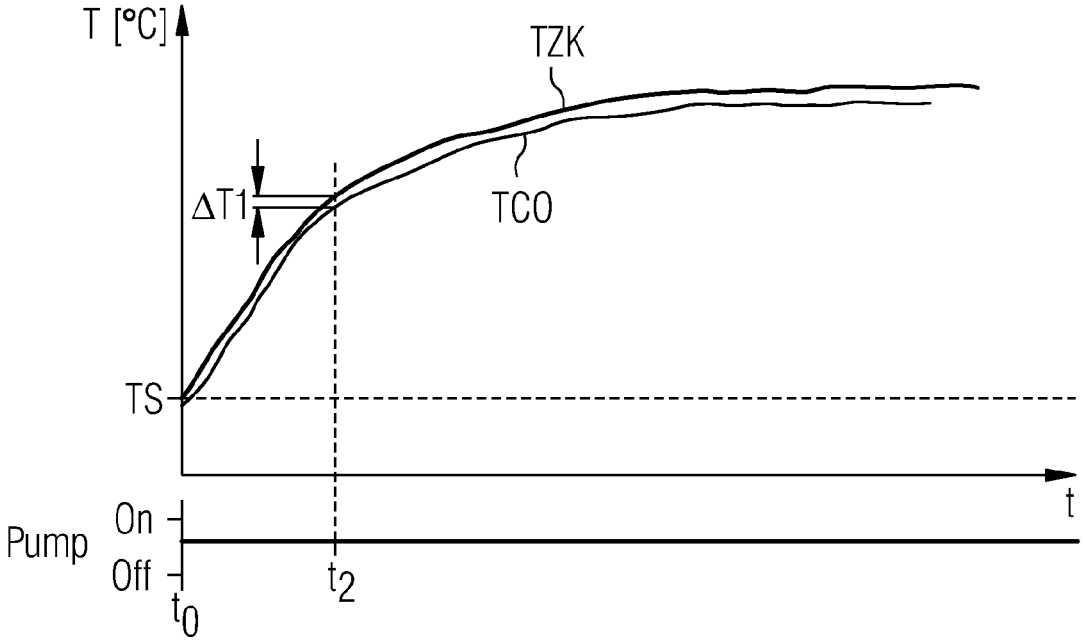
FIGS. 3 and 4 show time characteristics of the coolant temperature and the cylinder head temperature in a coolant pump that is not operating correctly.
Figure 4:
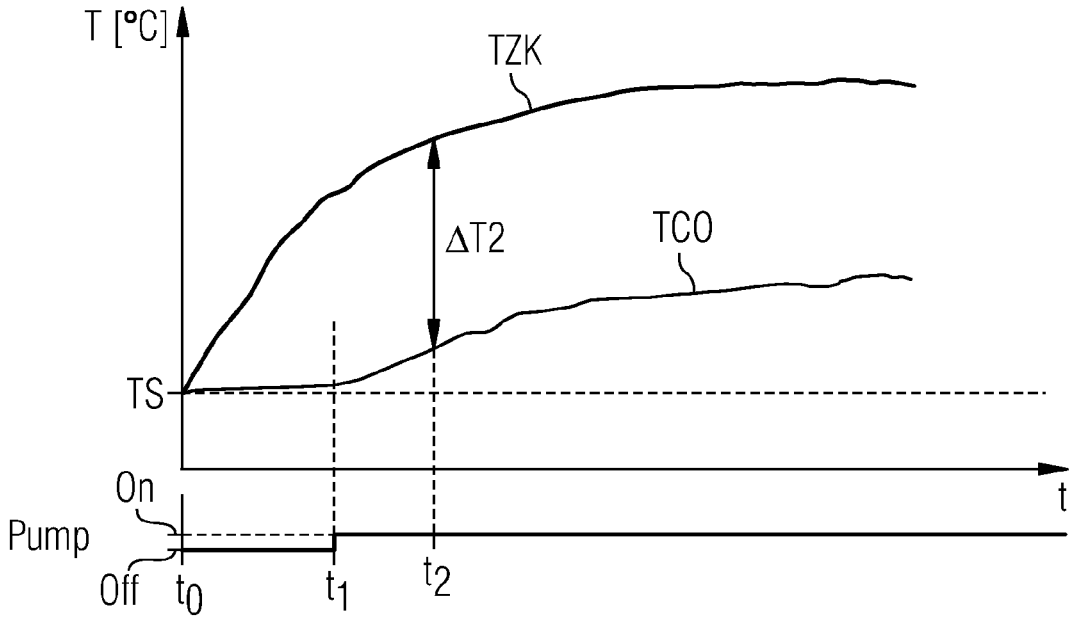

The control facility 26 is also connected to a memory 28 in which are stored, inter alia, predefined limits SW1-SW4 for two different temperature tolerance ranges whose significance will be dealt with in greater detail with reference to the description of FIGS. 2 to 4.

With reference to FIGS. 2 to 4 it will now be explained how the proper functioning of the coolant pump 11 can be checked by means of a comparison of the coolant temperature TCO with the cylinder head temperature TZK. A common aspect of all the figures is that the time characteristic in principle of the coolant temperature TCO and the cylinder head temperature TZK following the startup of the internal combustion engine 10 is plotted for different situations in the top part in each case, and the bottom part of the figures in each case shows the switching state (ON/OFF) of the coolant pump 11. While the coolant pump 11 is being checked, the radiator 18 is short-circuited by means of the bypass line 22.

FIG. 2 shows the typical warmup behavior of an internal combustion engine 10 that is equipped with a properly functioning coolant pump 11 which can be activated and deactivated. A so-called cold start of the internal combustion engine 10 takes place at time instant t0. At this time instant the coolant temperature TCO has the start value TS. A cold start of the internal combustion engine 10 of this kind can be detected by interrogation of specific operating parameters of the internal combustion engine, for example the coolant temperature, and comparison with a threshold value characterizing a cold start. At the time of the cold start the coolant pump 11 is deactivated, so no circulation of the coolant takes place. As a result the cylinder head and the coolant contained therein heat up very rapidly, which can be recognized by the steep rise of the curve for the cylinder head temperature TZK. Starting from the start value TS, the signal TCO of the coolant temperature sensor 27 which is located at the coolant outlet 14 (FIG. 1) of the cylinder head changes only marginally. Only at a time instant t1 at which the coolant pump 11 is activated does the signal of the coolant temperature sensor 27 also rise steeply and a relatively rapid alignment takes place between the coolant temperature TCO and the cylinder head temperature TZK. The time interval from the start of the internal combustion engine to the time instant t1, during which time interval the coolant pump 11 remains deactivated, thus inhibiting a coolant flow, is determined experimentally for the internal combustion engine 10 in question. It is essentially dependent on the structural embodiment of the internal combustion engine, in particular on the mass, the number of cylinders and the dimensioning of the cooling jacket. This time period is monitored by the elapsed-time meter 29 of the control facility 26.

FIG. 3 shows the time characteristics for the cylinder head temperature TZK and the coolant temperature TCO for the situation in which the coolant pump 11 cannot be deactivated from the time of a cold start of the internal combustion engine up to a time instant t1. A mechanical or an electrical fault can be the cause of this. The coolant pump 11 starts running immediately after the startup of the internal combustion engine and can no longer be switched off. The coolant is circulated by the coolant pump 11 and the heat resulting in the cylinder head due to the combustion in the combustion chambers is dissipated by way of the coolant, which means a relatively slow warming-up of the internal combustion engine and consequently leads to increased emissions. The characteristic curve of the coolant temperature TCO follows the characteristic curve of the cylinder head temperature TZK, a small, system-related difference remaining due to the mechanical design, i.e. the coolant temperature TCO is always somewhat lower than the cylinder head temperature TZK. At a time instant t1 at which the coolant pump 11 is normally first activated the two temperature values TCO and TZK are only marginally different from each other. In the case of a fault-free coolant pump 11 there ought to be a significant difference between the two temperature values at said time instant t1, as shown in FIG. 2.

This effect can be exploited for the purpose of checking the coolant pump 11. At the time instant t1 the values for the coolant temperature TCO and the cylinder head temperature TZK are recorded and compared with each other.

Toward that end the difference ΔT1=TZK−TCO is formed, for example, and then a check is carried out to determine whether said value ΔT1 lies within a predefined tolerance range defined by two limits SW3 and SW4. The limits SW3, SW4 for the tolerance range are determined experimentally by tests and are stored in the memory 28 of the control facility 26. If the value ΔT1 lies outside the tolerance range, the coolant pump 11 is rated as faulty and a fault code or fault message (e.g.: "Coolant pump cannot be deactivated") is stored in the fault memory 38 of the control facility 26 or output. In addition an acoustic and/or visual warning is output to the driver of the motor vehicle driven by means of the internal combustion engine 10. Alternatively the fault can be entered and the warning issued only when a specific number of values ΔT1 lie outside the tolerance range.

FIG. 4 shows temperature characteristic curves for the cylinder head temperature TZK and the coolant temperature TCO for the situation in which the coolant pump 11 cannot be activated at the time of a cold start of the internal combustion engine or in which in spite of a successful activation no coolant is being circulated. This can occur, for example, if the pump wheel (impeller) has become detached from the drive shaft such that it slips through on the shaft. In that case, in spite of the drive shaft being driven, coolant is no longer being pumped through the cooling circuit.

In the case of an electric coolant pump 11 a control signal is output at the time instant t1, whereas in the case of a mechanical coolant pump 11 the latter is brought into engagement with the internal combustion engine such that if the coolant pump 11 is functioning correctly, the coolant would be conveyed. After a further time interval following activation of the coolant pump 11 (time instant t1) has elapsed, the values for the coolant temperature TCO and the cylinder head temperature TZK are recorded at a time instant t2 and compared with each other. For that purpose the difference ΔT2=TZK−TCO is formed, for example, and then a check is carried out to determine whether said value ΔT2 lies within a further tolerance range bounded by two limits SW1 and SW2. The limits SW1, SW2 of said tolerance range and the time interval between the time instants t1 and t2 are determined experimentally by tests and stored in the memory 28 of the control facility 26. If the value ΔT2 lies outside the tolerance range, the coolant pump 11 is rated as faulty and a fault code or fault message (e.g.: "Coolant pump not circulating" or "Coolant pump cannot be activated") is stored or output. In addition an acoustic and/or visual warning is output to the driver of the motor vehicle driven by the internal combustion engine 10. Alternatively the fault can be entered and the warning issued only when a specific number of values ΔT2 lie outside the tolerance range. Because of the "standing coolant" the value recorded by the coolant temperature sensor 27 is very low even after the cold start phase of the internal combustion engine 10 has elapsed. Since the coolant cannot dissipate any heat, the cylinder head temperature increases sharply and overheating of the internal combustion engine can result, as a consequence of which damage can occur.

What is claimed is:

1. A method for diagnosing a coolant pump which is provided for the purpose of circulating a coolant in a closed cooling circuit of an internal combustion engine and which can be activated and deactivated independently of the operating state of the internal combustion engine, the method comprising:

at a predefined time instant after a cold start of the internal combustion engine has been detected, determining both a value representing the coolant temperature of the internal combustion engine and a value representing the cylinder head temperature of the internal combustion engine and subsequently comparing said values with each other, using a frequency counter to count a number of comparison results lying outside a tolerance range defined by one or more predefined limits, and rating the coolant pump as faulty when the number of comparison results lying outside the tolerance range exceeds a predefined maximum number.

2. The method according to claim 1, wherein the coolant pump is activated only after a predetermined time interval has elapsed since the cold start of the internal combustion engine and the temperature values are determined and compared after a further predetermined time interval has elapsed.

3. The method according to claim 1, wherein a check is carried out to determine whether the result of the comparison lies within a first tolerance range defined by predefined limits, and the coolant pump is rated as faulty if the result of the comparison lies outside the tolerance range.

4. The method according to claim 1, wherein the coolant pump is activated only after a predetermined time interval has elapsed since the cold start of the internal combustion engine and the temperature values are determined and compared at said time instant.

5. The method according to claim 1, wherein a check is carried out to determine whether the result of the comparison lies within a second tolerance range defined by predefined limits, and the coolant pump is rated as faulty if the result of the comparison lies outside the tolerance range.

6. The method according to claim 1, wherein the comparison is made by forming the difference between the two temperature values.

7. The method according to claim 3, wherein the limits of the tolerance ranges and the time intervals are determined experimentally on a test bench.

8. A device for diagnosing a coolant pump which is provided for the purpose of circulating a coolant in a closed cooling circuit of an internal combustion engine and which can be activated and deactivated independently of the operating state of the internal combustion engine, comprising a facility for determining a value representing the coolant temperature, a facility for determining a value representing the cylinder head temperature, comparator facility for comparing the values representing the coolant temperature and the cylinder head temperature, a frequency counter that counts a number of comparison results lying outside a tolerance range defined by one or more predefined limits, assessment facility which rates the coolant pump as faulty when the number of comparison results lying outside the tolerance range exceeds a predefined maximum number, and fault management facility that have at least one of a fault memory and a fault indicator device for at least one of: storing a fault code and outputting a warning message in the event of a faulty coolant pump.

9. The device according to claim 8, wherein the facility for determining a value representing the coolant temperature includes a temperature sensor.

10. The device according to claim 8, wherein the facility for determining a value representing the coolant temperature includes a model which calculates the coolant temperature from operating variables of the internal combustion engine.

11. The device according to claim 8, wherein the facility for determining a value representing the cylinder head temperature includes a temperature sensor.

12. The device according to claim 8, wherein the facility for determining a value representing the cylinder head temperature includes a model which calculates the cylinder head temperature from operating variables of the internal combustion engine.

13. The device according to claim 8, wherein the coolant pump is embodied as an electrically driven pump.

14. The device according to claim 13, wherein the electrically driven pump is embodied as a pump that can be regulated in terms of its output capacity.

15. The device according to claim 14, wherein the electrically driven pump is embodied as a pump that is reversible in terms of its coolant delivery direction.

16. The device according to claim 8, wherein the coolant pump is embodied as a pump that is driven mechanically by the internal combustion engine and whose drive can be activated and deactivated as necessary.

17. The device according to claim 8, wherein the facilities constitute component parts of a control facility controlling and regulating the internal combustion engine.

18. A device for diagnosing a coolant pump which is provided for the purpose of circulating a coolant in a closed cooling circuit of an internal combustion engine and which can be activated and deactivated independently of the operating state of the internal combustion engine, comprising an engine control unit comprising:

a first temperature sensor for measuring the coolant temperature, a second temperature sensor for measuring the cylinder head temperature, a comparator comparing output values of said first and second temperature sensors, a frequency counter that counts a number of comparison results lying outside a tolerance range defined by one or more predefined limits, an assessment unit configured to rate the coolant pump as faulty when the number of comparison results lying outside the tolerance range exceeds a predefined maximum number, and a fault management unit comprising at least one of a fault memory and a fault indicator device for at least one of: storing a fault code and outputting a warning message in the event of a faulty coolant pump.

19. The device according to claim 8, wherein the coolant pump is embodied as an electrically driven pump.

20. A method for diagnosing a coolant pump which is provided for the purpose of circulating a coolant in a closed cooling circuit of an internal combustion engine and which can be activated and deactivated independently of the operating state of the internal combustion engine, the method comprising:

at a predefined time instant after a cold start of the internal combustion engine has been detected, determining both a value representing the coolant temperature of the internal combustion engine and a value representing the cylinder head temperature of the internal combustion engine and subsequently comparing said values with each other, and determining whether the result of the comparison lies within a first tolerance range defined by predefined limits, and rating the coolant pump as faulty if the result of the comparison lies outside the tolerance range;

wherein the limits of the tolerance ranges and the time intervals are determined experimentally on a test bench.

21. The method according to claim 1, wherein the coolant pump includes a coolant pump controller.

* * * * *